United States Patent [19]

Cones, Sr. et al.

[11] Patent Number: 4,947,624

[45] Date of Patent: Aug. 14, 1990

[54] ARTICLE PROCESSING MACHINE AND METHOD OF MAKING SAME

[75] Inventors: James E. Cones, Sr., Cincinnati; James M. Phelps, Blankchester, both of Ohio

[73] Assignee: Planet Products Corporation, Cincinnati, Ohio

[21] Appl. No.: 349,174

[22] Filed: May 8, 1989

[51] Int. Cl.[5] ..... B65B 35/50

[52] U.S. Cl. ..... 53/540; 53/447; 198/418.4

[58] Field of Search ..... 53/540, 531, 147, 447, 53/443; 198/418.4

[56] References Cited

U.S. PATENT DOCUMENTS

| | | | |
|---|---|---|---|
| 3,131,614 | 5/1964 | Gillman | 53/540 X |
| 3,470,674 | 10/1969 | Madonia | 53/540 X |
| 3,479,792 | 11/1969 | Jensen et al. | 53/586 X |
| 3,908,539 | 9/1975 | O'Brien | 53/540 X |
| 4,235,329 | 11/1980 | Crawford et al. | 198/418.4 |

FOREIGN PATENT DOCUMENTS

| | | | |
|---|---|---|---|
| 2558340 | 7/1977 | Fed. Rep. of Germany | 198/418.4 |

*Primary Examiner*—James F. Coan

*Attorney, Agent, or Firm*—Kinney & Schenk

[57] ABSTRACT

An article processing machine is provided and comprises a conveyor device for moving articles and a stacking device for stacking the articles in pairs during movement through the machine and wherein the stacking device comprises a pivoted ramp assembly adapted to be pivoted to scoop thereon articles from the moving device and a pivoting mechanism for pivoting the ramp assembly to engage and scoop thereon in a serial manner alternate articles from the moving device and elevate same thereabove and a structure carried by the moving device for sliding each elevated article from the ramp assembly onto an associated alternate article carried by the moving device to define a stacked pair of articles.

30 Claims, 4 Drawing Sheets

ARTICLE PROCESSING MACHINE AND METHOD OF MAKING SAME

BACKGROUND OF THE INVENTION

1. Field of the Invention

This invention relates to an article processing machine and method of making same wherein the articles may be in the form of packages each containing a plurality of products such as food products covered by transparent shrink film, or the like. For example, each of the packages may contain food products such as sausages, poultry, frankfurters, or the like.

2. Prior Art Statement

It is known in the art to provide article processing machines each comprising moving means for moving articles and stacking means for stacking the articles in pairs during movement through the machine and, as shown, in U.S. Pat. No. 3,479,792 to Jensen et al, for example.

However, previous machines, including the above-mentioned machine to Jensen et al, have deficiencies in that, in general, such machines are comparatively complicated and expensive and are not capable of providing high speed efficient operation with minimum machine down time.

SUMMARY OF THE INVENTION

This invention provides a new machine and method of making same which substantially overcomes the above-mentioned deficiencies.

Accordingly, it is a feature of this invention to provide a new article processing machine comprising moving means for moving articles and stacking means for stacking the articles in pairs during movement through the machine.

In accordance with one embodiment of this invention, the stacking means comprises a pivoted ramp assembly adapted to be pivoted to scoop thereon articles from the moving means and pivoting means for pivoting the ramp assembly The ramp assembly is adapted to be pivoted by the pivoting means to receive and scoop thereon in a serial manner alternate articles from the moving means and elevate same thereabove, and sliding means for sliding each elevated article from the ramp assembly onto an associated alternate article disposed on the moving means to define a stacked pair of articles.

Another feature of this invention is to provide a new method of making an article processing machine comprising the steps of providing means for moving articles and providing stacking means for stacking the articles in pairs during movement through the machine.

In accordance with one embodiment of the new method of this invention, the step of providing stacking means comprises the further steps of providing a pivoted ramp assembly adapted to be pivoted to scoop thereon articles from the moving means, providing pivoting means for pivoting the ramp assembly, with the ramp assembly being adapted to be pivoted by the pivoting means to receive and scoop thereon in a serial manner alternate articles from the moving means and elevate same thereabove, and providing sliding means for sliding each elevated article from the ramp assembly onto an associated alternate article disposed on the moving means to define a stacked pair of articles.

Accordingly, it is an object of this invention to provide a new article processing machine having one or more of the novel features as set forth above or hereinafter shown or described.

Another object of this invention is to provide a new method of making an article processing machine having one or more of the novel features as set forth above or hereinafter shown or described.

Another object of this invention is to provide in an article processing machine of the character mentioned a new article stacking means and method of making same having one or more of the novel features as set forth above or hereinafter shown or described.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention in which.

DESCRIPTION OF THE PREFERRED EMBODIMENTS

Figure 1:
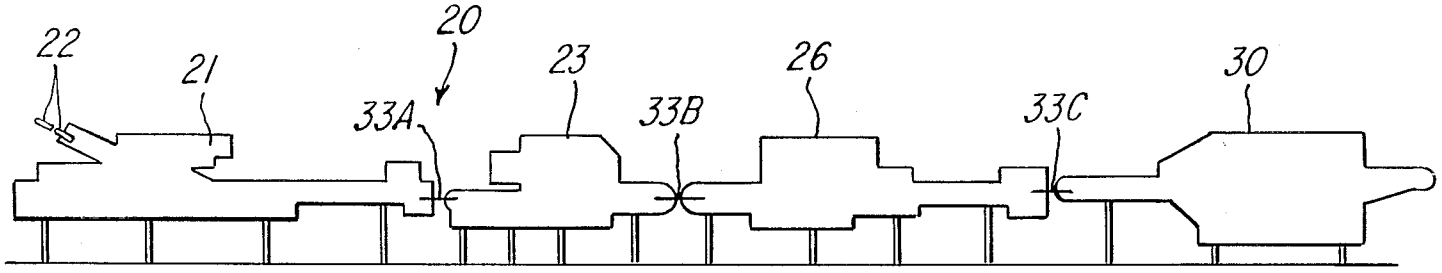
FIG. 1 is a schematic presentation of an article processing machine which employs the improved stacking means of this invention.

While the various features of this invention are hereinafter illustrated and described as being particularly adapted to provide a processing machine and method of making same which comprises moving means for moving articles and improved stacking means for stacking the articles in pairs during movement through the machine and wherein the articles may consist of individual articles in the form of packages containing individual products such as food products, or the like, it is to be understood that the various features of this invention can be utilized singly or in various combinations using techniques known in the art to process or stack a wide variety of products.

Therefore, this invention is not to be limited to only the embodiments illustrated in the drawings, because the drawings are merely utilized to illustrate certain ones of the wide variety of uses of this invention.

Reference is now made to FIG. 1 of the drawings which is a schematic presentation of a machine particularly adapted to process articles such as packages of food products, or the like, in a continuous high speed manner and such machine is designated generally by the reference numeral 20. The machine 20 comprises a loading device or loader 21 into which individual items such as frankfurters 22 are loaded. The loader prepares the individual frankfurters 22 for the packaging means or packager 23 and transfers some thereto.

Figure 2B:
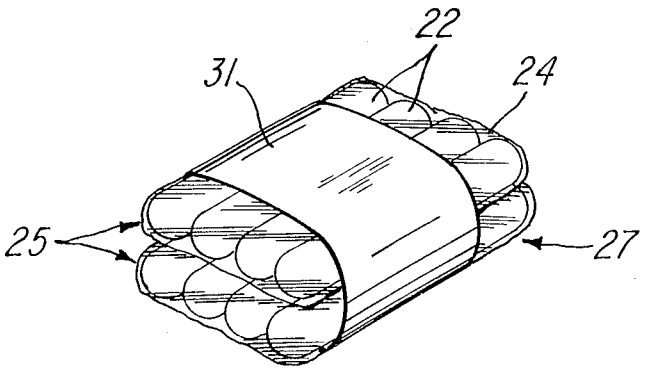
FIG. 2B is a view of the packages of FIG. 2A after passing through the machine and having a band attached therearound by a bander of the machine of FIG. 1.
Figure 2A:
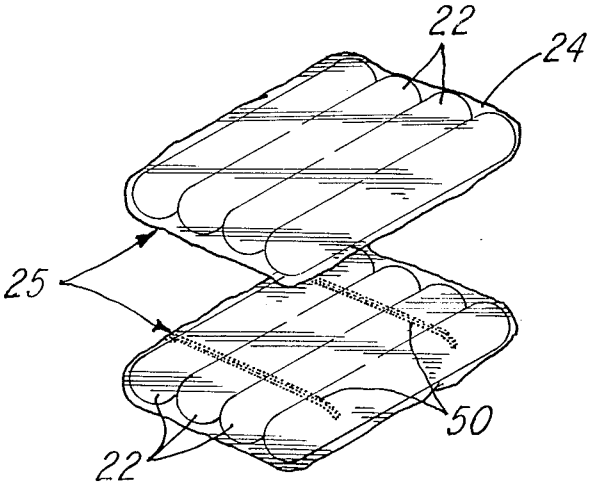
FIG. 2A is an isometric view of a pair of articles in the form of a pair of packages of frankfurters each covered with transparent shrink film and with the packages being shown spaced apart from each other to also highlight adhesive strips on the lower package.

In this example, the packager 23 separates the frankfurters into sets of four and wraps each set with a plastic film 24 which is preferably in the form of a transparent shrink film, or the like, and as shown in FIG. 2A. The packages so defined will be referred to interchangeably as articles or packages and designated generally by the reference numeral 25.

The articles 25 are then moved to the improved stacking means or device which is in accordance with the teachings of this invention and is designated generally by the reference numeral 26. The articles are processed in the stacking device or stacker 26 to define stacked pairs of articles which are designated generally by the reference numeral 27 in FIG. 2 of the drawings and each stacked pair of articles 27 is then moved to a banding device or bander 30 for applying a suitable band 31 therearound.

The primary purpose of the band 31 is identification; and, a stacked pair of articles 25 with such band 31 therearound is illustrated in FIG. 2B of the drawings and also designated by the reference numeral 27.

The loading device or loader 21, packaging device or packager 22, and banding device or bander 30 may be of suitable types known in the art and are suitably supported and operatively interconnected with the stacker 26 of this invention between the packager 23 and bander 30 (FIG. 1) to provide an efficient and high speed operation of the overall machine 20. Accordingly, the loader 21, packager 23, and bander 30 per se are not part of this invention.

The overall machine 20 has suitable means 33 for moving products therethrough and such means include moving means 33A for moving frankfurters between the loader 21 and packager 23 where packages 25 are made, moving means 33B for moving the packages 25 to the stacker 26 of this invention where the packages are stacked in pairs during movement through the machine, and moving means 33C for moving the stacked pair of articles 27 to the bander 30.

The moving means 33 of the machine 20 may comprise conveyor means 33 and in this example such conveyor means is in the form of a pair of conveyors 34 associated with and extending through the stacker 26. However, it will be appreciated that any desired number of conveyors 34 may be provided as part of the moving means 33 and through the stacker 26. Accordingly, and for simplicity, the detailed description will proceed with the same reference numerals being utilized for each conveyor 34 and components thereof inasmuch as such conveyors 34 and components are essentially identical.

The detailed description will now proceed with reference to a single conveyor 34; however, it is to be understood that the description is fully applicable to both conveyors 34.

In accordance with the teachings of this invention, the stacker 26 comprises a pivoted ramp assembly which is designated generally by the reference numeral 35 because the ramp assembly will have similar components associated with each conveyor 34; similar ramp assembly components will also be identified by the same reference numerals, for simplicity. Also, the detailed description will proceed with reference to the ramp assembly and components as applicable to a single conveyor 34. However, because identical reference numerals are used, it will be readily apparent that the description is applicable to all components of the ramp assembly as applicable to both conveyors 34.

The ramp assembly is adapted to be pivoted to scoop thereon articles or packages from the moving means or conveyor 34; and, the stacker 26 also comprises pivoting means designated generally by the reference numeral 36 for pivoting the ramp assembly 35 about a fixed axis 37 which is disposed above the upper run 39 of the conveyor 34. The ramp assembly 35 is adapted to be pivoted by the pivoting means 36 to receive and scoop thereon in a serial manner alternate articles from the conveyor 34 and elevate same thereabove, i.e., above the conveyor 34.

Figure 5:
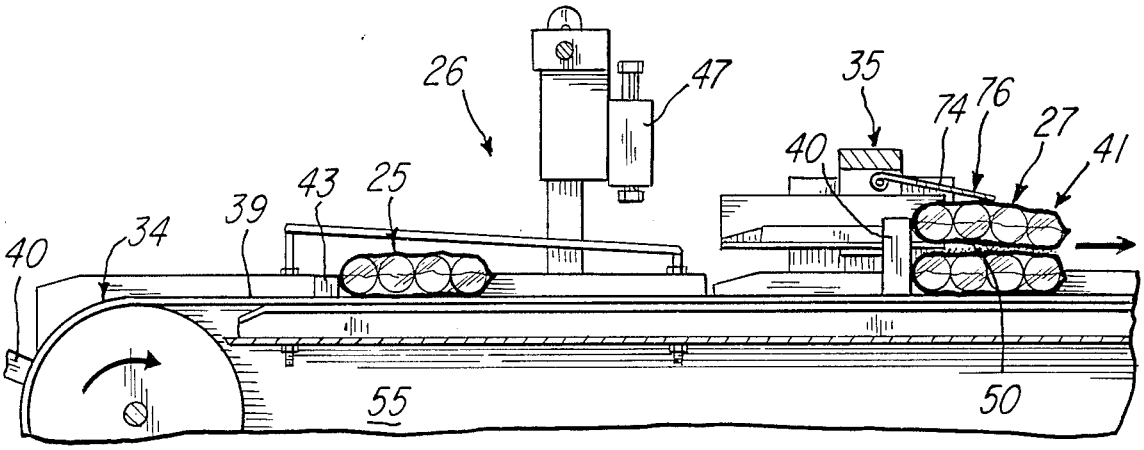
FIG. 5 is a view similar to FIG. 4 illustrating the manner in which a pair of articles are stacked and moved away from the ramp assembly.

The stacker 26 also comprises sliding means designated by the reference numeral 40 in FIG. 5 for sliding each elevated article 25 from the ramp assembly 35 onto an associated alternate article carried by the conveyor 34 to define a stacked pair of articles or packages 25 and as shown at 41, for example, in FIG. 5.

Figure 3:
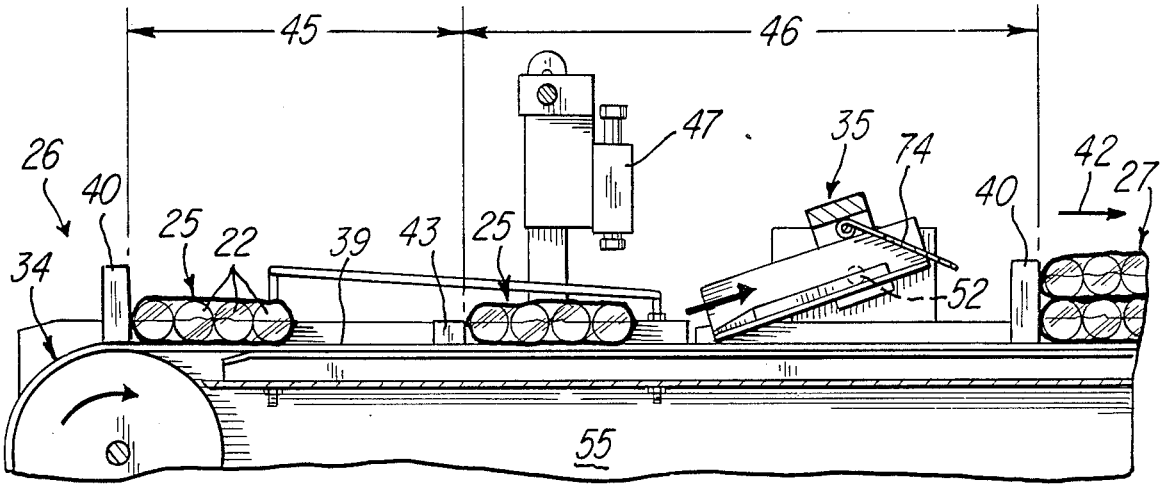
FIG. 3 is a fragmentary side view of the stacker prior to introduction of an article on a ramp assembly of such stacker.
Figure 4:
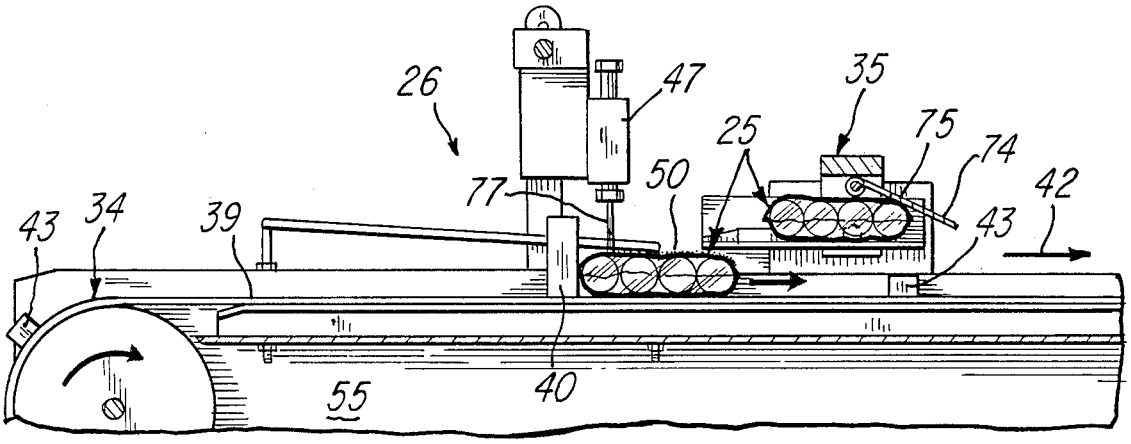
FIG. 4 is a view similar to FIG. 3 illustrating an article which has been scooped from moving means of the stacker and disposed in an elevated position and also illustrating the manner in which a following alternate article is moved therebeneath.

As previously mentioned, the moving means 33 is comprised of conveyor 34 which is in the form of an endless conveyor and has a substantially horizontally disposed upper run 39 which is particularly adapted to carry articles 25 in a substantially horizontal plane along a rectilinear path 42 and as seen in FIGS. 3 and 4. The conveyor 34 of the moving means 33 also has pushing means 43 (FIG. 3) for pushing alternate articles 25 onto the ramp assembly 35.

The conveyor 34 has a plurality of article locators fixed thereto for receiving associated articles 25 thereagainst and thereby controlling the positions of such articles on the conveyor. The article locators in this example comprise alternating short 43 and tall 40 conveyor flights wherein the short flights define the pushing means 43 and the tall flights define the sliding means 40.

Referring again to FIG. 3 of the drawings, it will be seen that the short and tall flights 43 and 40 respectively are disposed along the conveyor 34 to provide in the direction of movement of the conveyor along the rectilinear path 42 a tall flight 40 (far left of FIG. 3) followed by a short flight 43 with a first distance 45 therebetween followed by a tall flight 40 with a second distance 46 therebetween followed by a short flight (as shown in FIG. 4) with the first distance 45 therebetween and in a repeating manner along the entire length of the conveyor 34; with the first distance 45 being comparatively close to facilitate stacking of articles or packages 25 and the second distance 46 being greater than the first distance and sufficient to allow the ramp assembly 35 to be pivoted to perform its scooping function.

The machine 26 also comprises adhesive applicator means in the form of a pair of adhesive applicators associated with the pair of conveyors 34, with each adhesive applicator being designated generally by the reference numeral 47. As in the case of conveyors 34, the detailed description will proceed with only one applicator 47 since such description is applicable to both.

The adhesive applicator 47 is particularly adapted to apply adhesive to at least one of each stacked pair of articles 25. In this example of the invention, the adhesive applicator 47 is particularly adapted to apply adhesive in the form of a liquid adhesive in strip means comprised of a plurality of two adhesive strips. The adhesive strips are illustrated in FIG. 2A of the drawings and each is designated by the reference numeral 50. The adhesive applicator 47 may be of any type known in the art and have suitable controls (not shown), also of any suitable type known in the art, to assure the provision of adhesive strips 50 in an automatic manner to alternate ones of the articles as they are to be moved therebeneath by its conveyor 34. The adhesive applicator 47 operates to apply adhesive strips 50 to articles 25 moved therebeneath which become the bottom or lower article of the stacked pair of articles 27. In this example, such lower articles 25 are the ones located by the tall flights 40.

Figure 2:
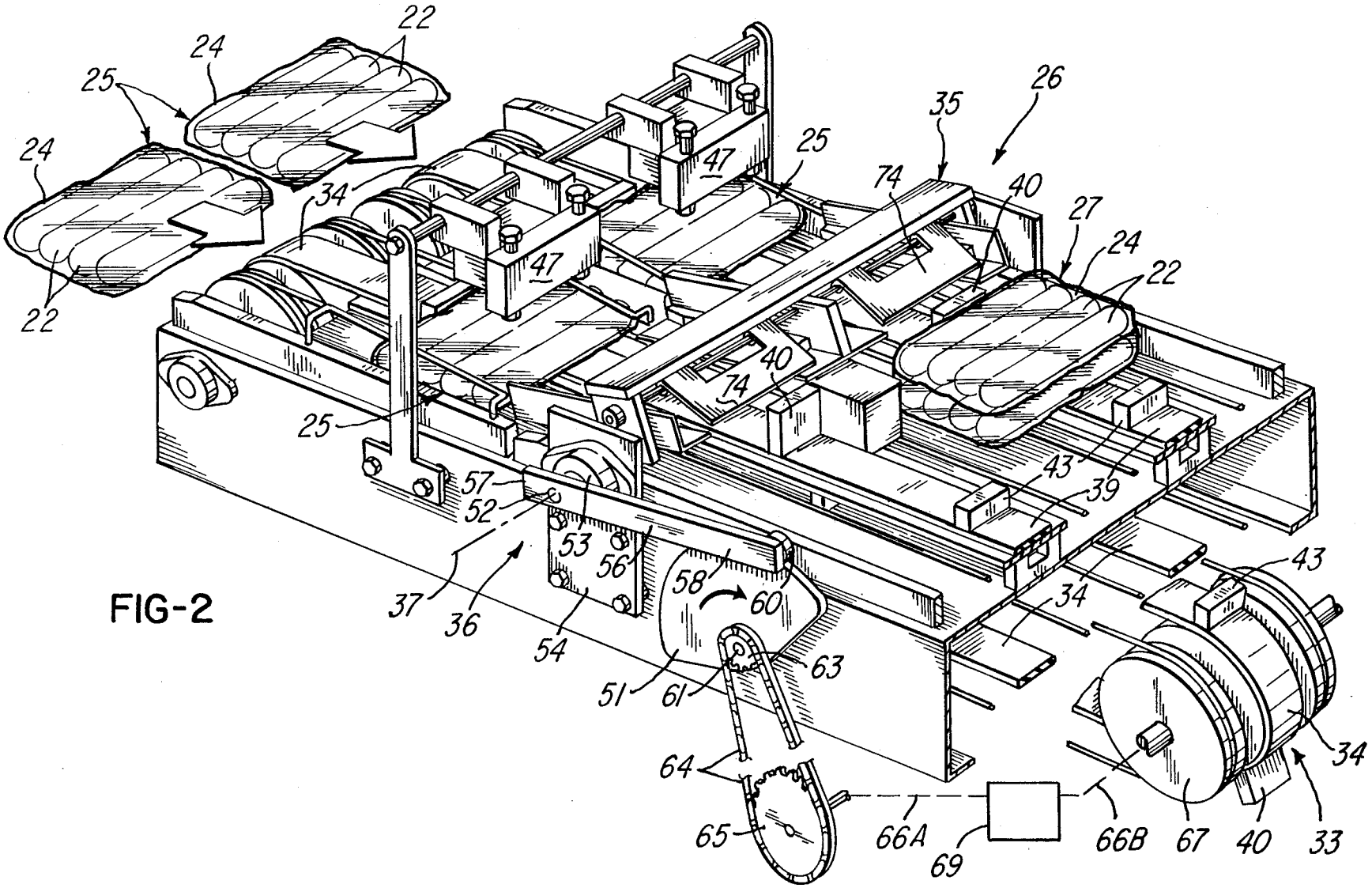
FIG. 2 is an isometric view with parts in cross-section and parts broken away illustrating one exemplary embodiment of the improved stacking means or stacker comprising the apparatus of FIG. 1.
Figure 6:
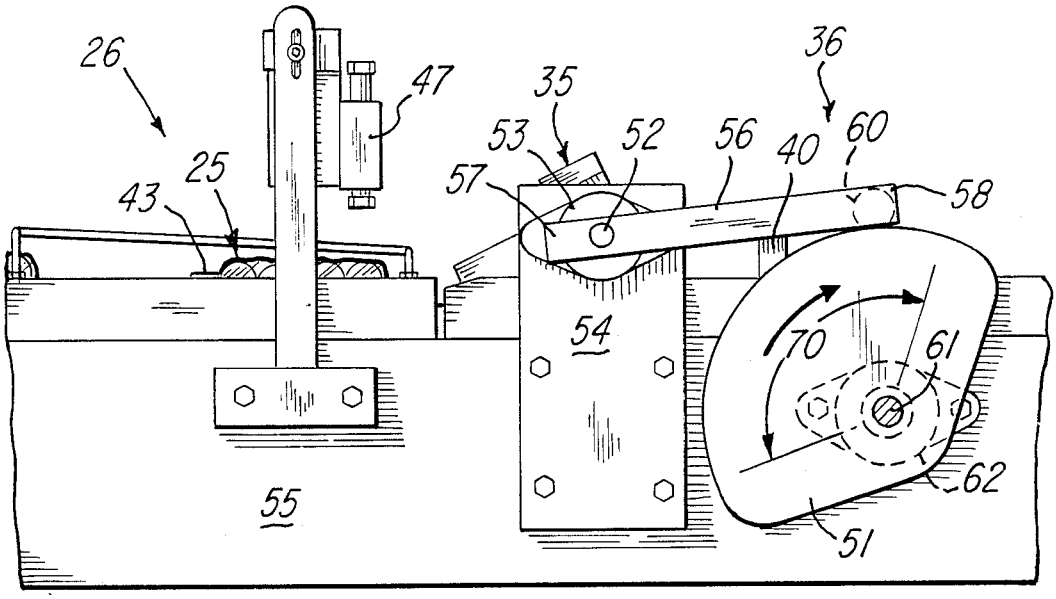
FIG. 6 is a side view of a pivoting mechanism for pivoting the ramp assembly and showing such pivoting mechanism at the position of FIG. 3.
Figure 7:
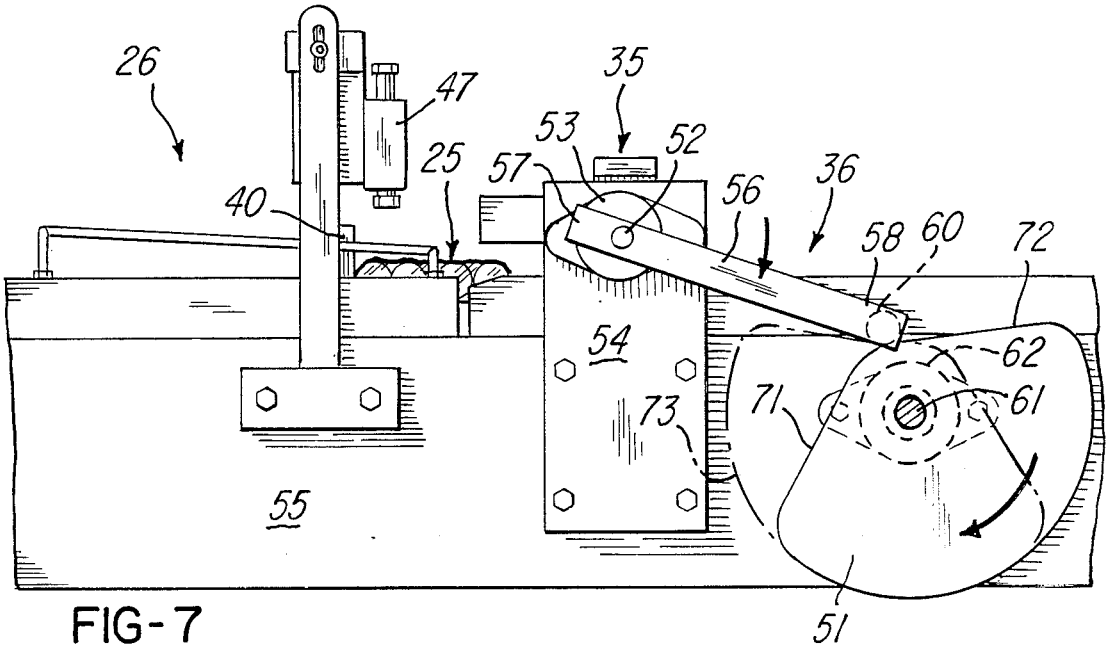
FIG. 7 is a view similar to FIG. 6 showing the pivoting mechanism essentially at the position of FIG. 4.

Referring now to FIGS. 2, 6 and 7 of the drawings, it will be seen that the pivoting means 36 comprises a cam 51 operatively associated with the conveyors 34 of the moving means 33 and synchronized with the sliding means or tall flights 40 and means operatively connected between the cam 51 and the pivoted ramp assembly 35 as will be subsequently described.

The pivoted ramp assembly 35 has shaft means or a pair of shafts 52 fixed thereto at opposite ends thereof for pivotally supporting same. The shafts 52 have longitudinal axes which coincide with the fixed axis 37 of the ramp assembly 35. Each shaft 52 is rotatably carried in a bearing assembly 53 which is in turn carried by a plate 54. Each plate 54 is suitably fixed by bolts, or the like, to the supporting frame 55 (FIGS. 6–7) comprising the stacker 26.

As previously mentioned, the pivoting means 36 comprises means operatively connected between the cam 51 and the pivoted ramp assembly 35; and, such operatively connected means comprises a lever 56 (FIG. 6) having one end 57 suitably fixed to the shaft means or an associated shaft 52 and having an opposite end 58 remote from end 57. A cam follower 60 is mounted on the opposite end 58 and such cam follower is suitably urged against the cam 51, preferably by the weight thereof. The cam 51 is constructed such that upon being engaged by the cam follower 60 during operation of the machine 20 and in particular the stacker 26 of such machine, the lever 56 causes rotation of the shaft means or shaft 52 to which it is attached to thereby pivot the ramp assembly 35 which is fixed to such shaft means 52 so as to receive thereon, in a scooping manner, the alternate articles or packages as previously mentioned.

The cam 51 is synchronized with the sliding means or tall flights 40 and thereby assures that each elevated article 25 is slid onto an associated article 25 therebeneath to define a stacked pair of articles, as shown at 41 in FIG. 5. The cam 51 is in the form of a rotatable cam plate, also designated by the reference numeral 51, and comprises a shaft 61 which is fixed to the cam plate 51 and is supported by bearing means 62 (FIG. 6) fastened to the frame structure 55 and enabling rotation of the cam plate 51 and shaft 61 adjacent the moving means 33 and in particular the conveyors 34 of the moving means.

Means for synchronizing the operation of the ramp assembly 35 with the conveyor 34; and, such means comprises a toothed sprocket 63 fixed to the shaft 61 and a sprocket chain 64 operatively associated with the sprocket 63. The chain 64 is adapted to engage the sprocket 63 and operatively associate with the conveyors 34 of the moving means 33. The operative association between the sprocket 63 and conveyors 34 may be by any suitable technique known in the art and preferably is through an associated sprocket 65 which receives chain 64 therearound and sprocket 63 is connected by suitable drive connection 66A to a gear box assembly 69. The gear box assembly 69 is in turn connected by a suitable drive connection 66B to a belt pulley 67 of a belt conveyor 34. The connections 66A, 66B and gear box 69 are shown schematically in FIG. 2.

With the above system, movement of the cam plate 51 is correlated in a precise manner with the movement of the conveyor 34 and, hence, movement of the short flights 43 and tall flights 40 fixed on such conveyor. Rotation of the cam plate 51 provides the desired pivoting action of the pivoted ramp assembly 35.

To highlight the operation of the pivoting means and the tie in to movement of articles 25, reference is now made to FIG. 6 of the drawings in which the cam or cam plate 51 is shown in the position of FIG. 3 and in this position the ramp assembly has been pivoted to receive an article or package 25 thereon. The synchorinized movement of the cam plate 51 as tied in with the conveyor 34 is such that in FIG. 7 the cam plate 51 has been rotated clockwise from the position of FIG. 6 and it will be seen that the construction of the cam plate 51 is such that the pivoted ramp assembly 35 is disposed horizontally, which is the position of FIG. 4.

The cam plate 51 is constructed to provide a dwell time at its scooping position, shown in FIG. 3. This dwell is achieved by the fact that lever 56 stays in the same position due to the cam follower 60 remaining in the same position due to engaging the constant radius arcuate portion of cam plate 51 through angular increment 70 (FIG. 6). Once the cam or cam plate 51 is rotated to pivot the ramp assembly 35 to the pivoted horizontal position of FIG. 4 the ramp assembly remains in the position of FIG. 4, as shown in FIG. 7, due to the cam follower 60 engaging the sides 71 and 72 of the cam which adjoins the arcuate portion 70. Rotation of the cam plate from the solid line position of FIG. 7 to the dot-dash line position 73 of such FIG. 7 results in the ramp assembly remaining in its elevated horizontal position shown in FIGS. 7 and 5. Thus, the cam plate 51 is constructed to position the ramp assembly in two positions, i.e., its scooping position of FIG. 3 and its horizontal position of FIGS. 4 and 5.

The stacker 26 also has a yieldable stop which is best illustrated in FIG. 4 of the drawings and designated by the reference numeral 74. The stop 74 is particularly adapted for limiting the movement of each article or package 25 scooped thereon by engaging the forward end of such package as shown at 75 in FIG. 4. The yieldable stop 74 may be any suitable type of stop but preferably is in the form of a spring-loaded arm which is adapted to be overridden by a stacked pair of articles 25 pushed by an associated sliding means or tall flight 40. The overriding action is shown in FIG. 5 at 76. The spring-loaded arm 74 may be spring loaded by any suitable means (not shown) known in the art to provide the stopping function at the desired location yet assuring that each package 25 which is slid upon the ramp assembly is capable of overriding the arm 74 upon being pushed by its sliding means or tall flight, and in the manner illustrated in FIG. 5.

As previously described, each article or package 25 of this example of the invention contains a plurality of products, shown as a plurality of food products in the form of frankfurters. Each package 25 preferably has an overwrap made of a transparent plastic material in the form of a plastic shrink film. In this example, the frankfurters of each particular package 25 are disposed in a single layer as shown in FIGS. 2 and 5 whereby the stacked pair of articles or packages 27 consists of two layers of packages of frankfurters with each layer or package wrapped in transparent shrink film. It has been found that consumers of food products such as frankfurters like the convenience of being able to purchase a dual pack consisting of a pair of packages 25 each having a sufficient number of frankfurters therein that oftentimes it is not necessary to open the second package of the pair until a later time when it is desired to consume the frankfurters in the second package.

As previously mentioned, the moving means 33 comprises a plurality of conveyors 34. Each conveyor 34 is preferably in the form of endless belt conveyors made of reinforced rubber-like material, or the like. Each belt conveyor 34 has article or package locators suitably fixed or detachably fastened thereto for receiving associated articles 25 thereagainst. The article locators are in the form of tall flights 40 and short flights 43, as previously described. In the case of detachably fastened locators or flights 40 and 43, same are preferably detachably fastened to their belt conveyor 34 utilizing any suitable means known in the art.

In the above description, reference was made to the application of adhesive such as adhesive strips 50 between packages 25 of each stacked pair. In this example adhesive strips 50 are applied by each applicator 47 which is synchronized so as to provide adhesive at the desired time to associated alternate articles to be stacked and preferably to the article 25 which will become the lower one of each stacked pair. FIG. 4 of the drawings illustrates the adhesive applicator 47 applying adhesive in the form of a liquid adhesive in stream means shown as streams 77 of adhesive. The streams 77 define the adhesive strips 50 once they engage a lower package 25.

As previously suggested, any suitable means known in the art may be provided to assure the provision of streams 77 to define the adhesive strips 50 in a synchronized manner so that adhesive is only discharged from an adhesive applicator 47 when an associated package is in position thereunder and the streams 77 of adhesive only flow from the adhesive applicator 77 during the time that a package which will become a lower package 25 of each stacked pair 27 of packages is in position under the applicator 47.

In this disclosure of the invention various controls, synchronizing means, prime mover means, and the like for the various components such as adhesive applicators 47, conveyors 34, etc. have not been illustrated and described. However, it will be appreciated that such items will be provided as known in the art utilizing any suitable structure and means known in the art.

In this disclosure of the invention, terms such as "upper", "lower", "horizontal", "bottom" and the like have been used throughout. However, it will be appreciated that these terms and similar terms were used in connection with the relative arrangement of components as illustrated in the drawings and such terms are not to be considered as limiting the scope of this invention in any way.

While the forms and method of this invention now preferred have been illustrated and described as required by the Patent Statute, it is to be understood that other forms and method steps can be utilized all within the scope of the appended claims wherein each claim sets forth what is believed to be known in each claim prior to this invention in that portion of each claim that is disposed before the words "the improvement" and sets forth what is believed to be new in each claim according to this invention in that portion of each claim that is disposed after the words "the improvement" whereby it is believed that each claim sets forth a novel, useful, and unobvious invention within the purview of the Patent Statute.

What is claimed is:

1. In an article processing machine comprising moving means for moving articles and stacking means for stacking said articles in pairs during movement through said machine, the improvement wherein said stacking means comprises a pivoted ramp assembly adapted to be pivoted to scoop thereon articles from said moving means and pivoting means for pivoting said ramp assembly, said ramp assembly being adapted to be pivoted by said pivoting means to receive and scoop thereon in a serial manner alternate articles from said moving means and elevate same thereabove, and sliding means for sliding each elevated article from said ramp assembly onto an associated alternate article disposed on said moving means to define a stacked pair of articles.

2. A machine as set forth in claim 1 in which said moving means comprises an endless conveyor having a substantially horizontally disposed upper run adapted to carry said articles in a substantially horizontal plane along a rectilinear path, said conveyor having pushing means for pushing alternate articles onto said ramp assembly.

3. A machine as set forth in claim 2 in which said conveyor has a plurality of article locators fixed thereto for receiving associated articles thereagainst and thereby controlling the positions of said articles on said conveyor.

4. A machine as set forth in claim 3 in which said article locators comprise alternating short and tall conveyor flights, said short flights defining said pushing means and said tall flights defining said sliding means.

5. A machine as set forth in claim 4 in which said short and tall flights are disposed along said conveyor to provide in the direction of movement of said conveyor along said rectilinear path a tall flight followed by a short flight with a first distance therebetween followed by a tall flight with a second distance therebetween followed by a short flight with said first distance therebetween and in a repeating manner along the entire length of said conveyor, said first distance being comparatively close to facilitate said stacking and said second distance being greater than said first distance and sufficient to allow said ramp assembly to be pivoted to perform its scooping action.

6. A machine as set forth in claim 1 and further comprising an adhesive applicator for applying adhesive to at least one of each stacked pair of articles.

7. A machine as set forth in claim 6 in which said adhesive applicator is adapted to apply said adhesive in strip means.

8. A machine as set forth in claim 7 in which said strip means comprises a plurality of adhesive strips.

9. A machine as set forth in claim 1 in which said pivoting means comprises a cam operatively associated with said moving means and synchronized with said sliding means and means operatively connected between said cam and said ramp assembly.

10. A machine as set forth in claim 4 in which said ramp assembly has shaft means fixed thereto for pivotally supporting same, said pivoting means comprises a cam operatively associated with said moving means and synchronized with said sliding means and article locators, a lever having one end fixed to said shaft means and having an opposite end remote therefrom, a cam follower mounted on said opposite end of said lever, said cam follower being urged against said cam, said cam being constructed such that upon being engaged by said cam follower during operation of said machine said lever is caused to rotate said shaft means and thereby pivot said ramp assembly to receive thereon in a scooping manner said alternate articles, said cam due to being synchronized with said sliding means assuring each elevated article is slid onto an associated article to define an associated stacked pair of articles.

11. A machine as set forth in claim 10 in which said cam comprises a rotatable cam plate, and further comprising a shaft fixed to said cam plate and supported to provide rotation of said cam plate and shaft adjacent said moving means, a toothed sprocket fixed to said shaft, and a sprocket chain adapted to engage said sprocket and operatively associate with said moving means.

12. A machine as set forth in claim 1 and further comprising a yieldable stop on said ramp assembly for limiting the movement of each article scooped thereon.

13. A machine as set forth in claim 12 in which said yieldable stop comprises a spring loaded arm which is adapted to be overridden by said sliding means.

14. A machine as set forth in claim 1 in which each article is a package containing a plurality of products.

15. A machine as set forth in claim 1 in which each article is a package containing a plurality of food products wrapped with a plastic material, said food products being disposed in a single layer and said stacked pair of articles consisting of two layers of food products.

16. In a method of making an article processing machine comprising the steps of providing means for moving articles and providing stacking means for stacking said articles in pairs during movement through said machine, the improvement in said method wherein said step of providing stacking means comprises the further steps of providing a pivoted ramp assembly adapted to be pivoted to scoop thereon articles from said moving means, providing pivoting means for pivoting said ramp assembly, said ramp assembly being adapted to be pivoted by said pivoting means to receive and scoop thereon in a serial manner alternate articles from said moving means and elevate same thereabove, and providing sliding means for sliding each elevated article from said ramp assembly onto an associated alternate article disposed on said moving means to define a stacked pair of articles.

17. A method as set forth in claim 16 in which said step of providing moving means comprises the step of providing an endless conveyor having a substantially horizontally disposed upper run adapted to carry said articles in a substantially horizontal plane along a rectilinear path, and said step of providing an endless conveyor comprises providing said conveyor having pushing means for pushing alternate articles onto said ramp assembly.

18. A method as set forth in claim 17 in which said step of providing an endless conveyor comprises providing said conveyor having a plurality of article locators fixed thereto for receiving associated articles thereagainst and thereby controlling the positions of said articles on said conveyor.

19. A method as set forth in claim 18 in which said step of providing said endless conveyor which has a plurality of article locators fixed thereto comprises providing said article locators in the form of alternating short and tall conveyor flights detachably fixed to said conveyor, said short flights defining said pushing means and said tall flights defining said sliding means.

20. A method as set forth in claim 16 and comprising the further step of providing an adhesive applicator for applying adhesive to at least one of each stacked pair of articles.

21. A method as set forth in claim 20 and comprising the further step of providing an adhesive applicator which is adapted to apply said adhesive to the lower one of said stacked articles in a plurality of adhesive strips disposed in parallel relation.

22. A method as set forth in claim 16 in which said step of providing pivoting means comprises providing a cam operatively associated with said moving means and synchronized with said sliding means and comprising the further step of providing means operatively connected between said cam and said ramp assembly.

23. In an article processing machine comprising a conveyor for moving articles and stacking means for stacking said articles in pairs during movement through said machine, the improvement wherein said stacking means comprises a pivoted ramp assembly adapted to be pivoted to scoop thereon articles from said conveyor and pivoting means for pivoting said ramp assembly about a fixed axis above said conveyor, said ramp assembly being adapted to be pivoted by said pivoting means to engage and scoop thereon in a serial manner alternate articles from said conveyor and elevate same thereabove, and sliding means carried by said conveyor for sliding each elevated article from said ramp assembly onto an associated alternate article carried by said conveyor to define a stacked pair of articles.

24. A machine as set forth in claim 23 in which said articles are in the form of packages each containing a plurality of products.

25. A machine as set forth in claim 24 in which said products consist of food products covered by transparent film shrunk therearound.

26. A machine as set forth in claim 25 in which said conveyor comprises an endless belt conveyor made of a rubber-like material and having a substantially horizontally disposed upper run adapted to carry said packages in a substantially horizontal plane along a rectilinear path, said belt conveyor having pushing means for pushing alternate packages onto said ramp assembly.

27. A machine as set forth in claim 26 in which said belt conveyor has a plurality of package locators carried thereon for receiving associated packages thereagainst and thereby controlling the positions of said packages on said conveyor.

28. A machine as set forth in claim 27 in which said package locators comprise alternating short and tall conveyor flights detachably fastened to said belt conveyor, said short flights defining said pushing means and said tall flights defining said sliding means.

29. A machine as set forth in claim 28 in which said short and tall flights are disposed along said belt conveyor to provide in the direction of movement of said conveyor along said rectilinear path a tall flight followed by a short flight with a first distance therebetween followed by a tall flight with a second distance therebetween followed by a short flight with said first distance therebetween and in a repeating manner along the entire length of said belt conveyor, said first distance being comparatively close to facilitate said stacking and said second distance being greater than said first distance and sufficient to allow said ramp assembly to be pivoted to perform its scooping action.

30. A machine as set forth in claim 29 and further comprising an adhesive applicator for applying adhesive to the lower one of each stacked pair of packages, said adhesive applicator being adapted to apply said adhesive in a plurality of adhesive strips disposed in parallel relation.

* * * * *